US006578462B1

(12) United States Patent
Franchino et al.

(10) Patent No.: US 6,578,462 B1
(45) Date of Patent: Jun. 17, 2003

(54) RADIAL-VENTING BAFFLED MUZZLE BRAKE

(75) Inventors: Anthony R. Franchino, Whitehouse Station, NJ (US); Thomas Tighe, Morristown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/907,890

(22) Filed: Jul. 12, 2001

Related U.S. Application Data

(60) Provisional application No. 60/235,192, filed on Sep. 25, 2000.

(51) Int. Cl.[7] ..... F41A 21/36
(52) U.S. Cl. ..... 89/14.3; 89/14.2
(58) Field of Search ..... 89/14.3, 14.2, 89/14.05, 14.4, 14.1, 14.5

(56) References Cited

U.S. PATENT DOCUMENTS

| | | | | | |
|---|---|---|---|---|---|
| 1,174,165 | A | * | 3/1916 | Kenney | 89/14.3 |
| 1,327,897 | A | * | 1/1920 | Baldwin | 89/14.3 |
| 1,434,044 | A | * | 10/1922 | Cooke | 89/14.3 |
| 5,036,747 | A | * | 8/1991 | McClain, III | 89/14.3 |
| 5,631,438 | A | * | 5/1997 | Martel | 89/14.3 |

FOREIGN PATENT DOCUMENTS

| | | | | |
|---|---|---|---|---|
| GB | 2190474 | A | * 11/1987 | F41C/21/18 |

OTHER PUBLICATIONS

C.L. Farrar and D.W. Leeming, "Military Ballistics: A Basic Manual", 1983, Brassey's Publishers Limited , pp. 67–68.*

A. Bellot, "La Precision Du Tir Doit Croitre Avec La Vitesse Des Avions", Jul. 1936, pp. 147–149.*

* cited by examiner

*Primary Examiner*—Michael J. Carone
*Assistant Examiner*—Gabriel S. Sukman
(74) *Attorney, Agent, or Firm*—John F. Moran; Michael C. Sachs

(57) ABSTRACT

An improved muzzle brake for reducing the momentum of the recoiling components of a gun or cannon when fired, thereby reducing the forces acting on the support platform of a weapon system, is provided. In the presence of the muzzle brake, the projectile fired from a cannon to restrains the gas flow in the axial direction until gases are allowed to be diverted to a baffle in the main body of the muzzle brake. The resultant gas flow impinges on the baffle, thereby inducing a forward thrust. The diverted gas flow then exits through a plurality of exhaust ports provided to the atmosphere to create a thrust applied to the recoiling components of the gun system. Additional thrust is created by the inclusion of a second stage baffle, offset from the main body of the muzzle brake at an optimal distance by a plurality of standoffs. This thrust generates an impulse that is applied in the opposite direction of the recoil momentum by the amount of the muzzle brake impulse. The resulting reduced forces result in lighter cannon support structures, enhancing mobility and effectiveness.

22 Claims, 7 Drawing Sheets

RADIAL-VENTING BAFFLED MUZZLE BRAKE

RELATED APPLICATIONS

This application claims benefit under 35 USC 119(e) of provisional application 60/235,192 filed Sep. 25, 2000, the entire file wrapper contents of all of which application are herewith incorporated by reference as though fully set forth herein at length.

GOVERNMENTAL INTEREST

The invention described herein may be manufactured and used by or for the Government of the United States for governmental purposes without the payment of any royalties thereon.

FIELD OF THE INVENTION

This invention relates to the field of military ordnance and, in particular, to the field of large caliber cannons, as typified by artillery weapons, where recoil forces are of major concern in the overall design. More specifically, the invention pertains to muzzle brakes as applied to large caliber guns and cannons and to the use of these brakes in the control of recoil forces during firing.

BACKGROUND OF THE INVENTION

Large caliber military weapons, of which the U.S. Army's 155 mm Self-Propelled Howitzer (one example known and referred to herein as "Crusader") is an exemplary case, deliver heavy rounds at relatively high velocities to distant targets. Simple conservation of momentum considerations dictate that the weapons and their support platforms are subject to heavy recoil forces during firing and, hence, to the negative effects of the recoil. It is common practice to mitigate the recoil and, thus, reduce the forces acting on the support platform of the weapon by installing or integrating a so-called muzzle brake at or near the muzzle end of the gun. These reduced forces result in lighter cannon support structures, enhancing mobility and effectiveness.

A muzzle brake is a device used to reduce the momentum of the recoiling components of a gun or cannon when fired by diverting the flow of propellant gases to produce an impulse that counters the breech-directed recoil of the gun. In traditional forms the brake may include a series of baffles either perpendicular or nearly perpendicular to the cannon tube axis or, alternatively, may be implemented as an integral perforated tube that consists of a series of radial holes located in the muzzle region of the cannon.

The need for, and efficacy of, such a device may be understood by considering the following: When the weapon is fired, the propellant burns rapidly and expands in volume inside the cannon. The projectile is accelerated along the length of the barrel by the expanding gases and is ejected at high velocity (on the order of 1000 m/s) from the muzzle end of the barrel. The high pressure propellant gases, exerting pressures of thousands of pounds per square inch, follow the projectile and are expelled into the atmosphere at velocities equaling and even exceeding those of the projectile. The combination of the accelerated projectile and propellant gases exiting the muzzle of the weapon produces a large breech-directed recoil thrust that is transmitted to the support structure.

It is understood that the magnitude and temporal characteristics of the recoil directly affect the design and implementation of the support structure. By installing or integrating a muzzle brake to the weapon the magnitude of the recoil and the forces transmitted to the support structure can be reduced by diverting the propellant gases and taking advantage of the impulse that is generated.

The firing event can be analyzed in two general scenarios: with and without a muzzle brake. In the case where no muzzle brake is installed, the high pressure, high velocity gases exit the muzzle and expand into the ambient atmosphere, creating substantial thrust and, thus, contribute an appreciable bore-directed force that is subsequently transmitted to the gun's support structure. In contradistinction, when a muzzle brake is installed, a different sequence of events ensures. The projectile, accelerating down the length of the barrel, passes the muzzle brake and continues to restrain the propellant gases in the axial direction. Consequently, the expanding, high pressure gases are diverted to the baffles or to the forward face radial holes that comprise the muzzle brake. The diverted gases exit through ports in the muzzle brake to produce an impulse-like thrust that counters the breech-directed recoil of the gun, thereby reducing the recoil and the force transmitted to the gun's support structure.

Muzzle brakes have traditionally been implemented in two major types. The first is an integral, perforated brake. In this implementation, an array of radial holes is drilled into the existing barrel of the weapon, at or near the muzzle. As an example, the Crusader has 120 radial holes arranged in ten axial rows, each with twelve equally-spaced circumferential locations. Gases impinge on the forward faces of the radial holes and subsequently change direction, ultimately being expelled axisymmetrically and almost radially around the muzzle of the brake. The interaction between the gas and the brake results in a momentum that counteracts the recoil of the gun.

The gas dynamic efficiency, $\beta$, of such a brake is 0.6 or less, meaning that the reduction in recoil is somewhat limited. The lack of efficiency is offset somewhat by the simplicity (i.e., no components are added to the design), ease of fabrication, low cost, low added weight and minimal length of the design. It should also be noted that due to the axisymmetric placement of the exhaust ports, a fraction of the propellant gas is expelled downward, producing what is known as a ground surface disturbance that may affect the weapons platform and the crew that is operating the weapon.

A second type of muzzle brake is the so-called "German baffle." In this design, a small number of baffles (typically 1 or 2) is incorporated into a separate assembly that attaches to the muzzle end of the barrel. The baffles and gas exhaust ports of this design lie in the horizontal plane and, thus, gases are expelled laterally, that is, parallel to the plane of the local ground. Thus, this design avoids the ground surface disturbance associated with the perforated brake. Advantageously, the German brake has a gas dynamic efficiency, $\beta$, that may approach or exceed 1, implying a strong reduction in force transmitted to the support platform. However, the increased efficiency is offset by the cost and complexity of the units along with the penalties paid in weight. In addition, the relative complexity of the German baffle increases stress concentrations in undesirable areas and increases its manufacturing costs, with reliance on complex castings to produce the final product.

These two types of devices exemplify the current state-of-the-art in muzzle brake design. Though the structures described above may have satisfied their intended purpose, there still remains an unsatisfied need for an improved muzzle brake that achieves the desired goals of increased gas dynamic efficiency without endangering the crew of the weapons platform, decreased production costs, ease of manufacturing and assembly, and flexibility/tenability, as well as reduced weight and length.

SUMMARY OF THE INVENTION

The radial venting baffled muzzle brake of the current invention addresses the forgoing need. It also meets the following criteria:

1. minimized weight;
2. ease of manufacture and assembly;
3. optimized gas dynamic efficiency balanced with crew and platform safety;
4. minimized size;
5. flexibility and tenability; and
6. optimized material stress distribution.

It is a feature of the present invention to minimize the weight, size and length associated with the muzzle brake while achieving and maintaining a rugged and reliable design. This is achieved by fabricating the brake from lightweight materials and employing a novel, high efficiency design.

In a preferred embodiment, the brake is manufactured from lightweight, surface-treated titanium. Furthermore, the design achieves its desired performance with a compact, multistage, axisymmetric implementation that further minimizes weight, length and overall size of the brake.

An integral first stage baffle allows for a smooth transition to the radial exit passages, thereby maximizing its efficiency. In addition, the design and implementation of the main body of the brake allows for a radially uniform muzzle exit nozzle and incorporates a radially uniform first stage baffle. Thus, the geometry of these features strongly and positively influence muzzle brake efficiency.

Furthermore, the fillet radii transition between the main body's integral gas deflection baffle and the exit passages are carefully engineered to assure uniform stress distribution and structural integrity, while maximizing brake performance.

The second stage baffle of the multi-stage design also allows for a smooth transition to the radial exit passages, thereby maximizing its efficiency. In addition, the second stage baffle design also incorporates a radially uniform muzzle exit nozzle, which strongly influences muzzle brake efficiency.

Furthermore, the fillet radii transition between the baffle and the exit passage is designed to assure structural integrity while maximizing brake performance. One further advantage of the invention is the design's uniformity of structure, which enhances stress distribution from firing loads and thereby allows the structure size to be reduced to optimize overall system weight.

Another feature of the present invention is to employ standard manufacturing and assembly techniques in the implementation of the brake. In the preferred embodiment individual parts display a high degree of cylindrical symmetry, allowing them to be produced with standard machine tools, and/or simple casting methods. For final construction, the individual parts are readily assembled with standard tools and in final installation the brake, simply threads onto the muzzle of the cannon barrel. The design and implementation of the preferred embodiment reduces the overall cost of the brake.

Yet another feature of the present invention is to increase the gas dynamic efficiency of the brake to a level that will not endanger the crew or the support platform for the weapon. A high gas dynamic efficiency, $\beta$, estimated to exceed 1.2, is achieved by employing a two-stage baffle design with axisymmetric venting. This gas dynamic efficiency may be increased or decreased as required by altering certain physical characteristics including baffle size, baffle deflection angle, and gas exit area.

The present design improves upon the gas dynamic efficiency of traditional "German Baffle" type design by utilizing full axisymmetric gas expulsion to achieve optimized propellant gas exit passage area per unit length. Additional baffles (e.g., a tertiary baffle) can be added to the design to further increase the gas dynamic efficiency, $\beta$, of the muzzle brake with minimal weight impact.

Still another feature of the present invention is flexibility and "tunability" of the brake. The secondary baffle (or baffles, in the most general case) may be easily installed and removed enhancing internal stowage for transportation by reducing the total payload volume. In fact, the brake may be efficaciously and safely operated with the second stage baffle removed. It is estimated that the brake can achieve a gas dynamic efficiency, $\beta$, approaching 1.0 with no secondary baffle installed.

In addition, the second stage baffle is readily adjusted by changing the length and diameter of the standoffs that couple the secondary deflection baffle to the main body of the brake. In this manner, the brake may be adjusted to conform to the particular operating conditions of the weapon.

The foregoing and additional features and advantages of the present invention are realized by implementing a multistage baffle design with full radial venting of expelled propellant gases. The main body of the device comprises an internally-threaded, cylindrically shaped lug, a cylindrically symmetric gas baffle, and a plurality of gas exhaust ports which are arranged in such a manner as to take maximum practical advantage of available exhaust gas energy.

The main body of the muzzle brake is threaded onto an existing gun barrel and further secured with a key and collar arrangement to prevent loosening as a result of repeated use. A secondary gas deflection baffle may be secured to the main body of the muzzle brake by means of a plurality of cylindrical standoffs and an equal number of nuts. The axisymmetric secondary baffle is installed a predetermined distance from the first, to optimize braking efficiency. The intervening spaces between the standoffs serves secondary gas exhaust ports.

The muzzle brake of the current invention is easily produced using conventional manufacturing techniques, easily assembled with standard tools, achieves high gas dynamic efficiency without endangering the weapons platform or the gun crew, and is both lightweight and compact. The axisymmetry of the design prevents unbalanced forces and moments from being applied to the barrel of the cannon and, furthermore, assures high efficiency for the design. In particular, the gas dynamic efficiency, $\beta$, of the invention exceeds that of the traditional German baffle and doubles the gas dynamic efficiency, $\beta$, of a standard, integral perforated brake.

BRIEF DESCRIPTION OF THE DRAWINGS

The above and other features of the present invention and the manner of attaining them, will become apparent, and the invention itself will be best understood, by reference to the following description and the accompanying drawings, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1:
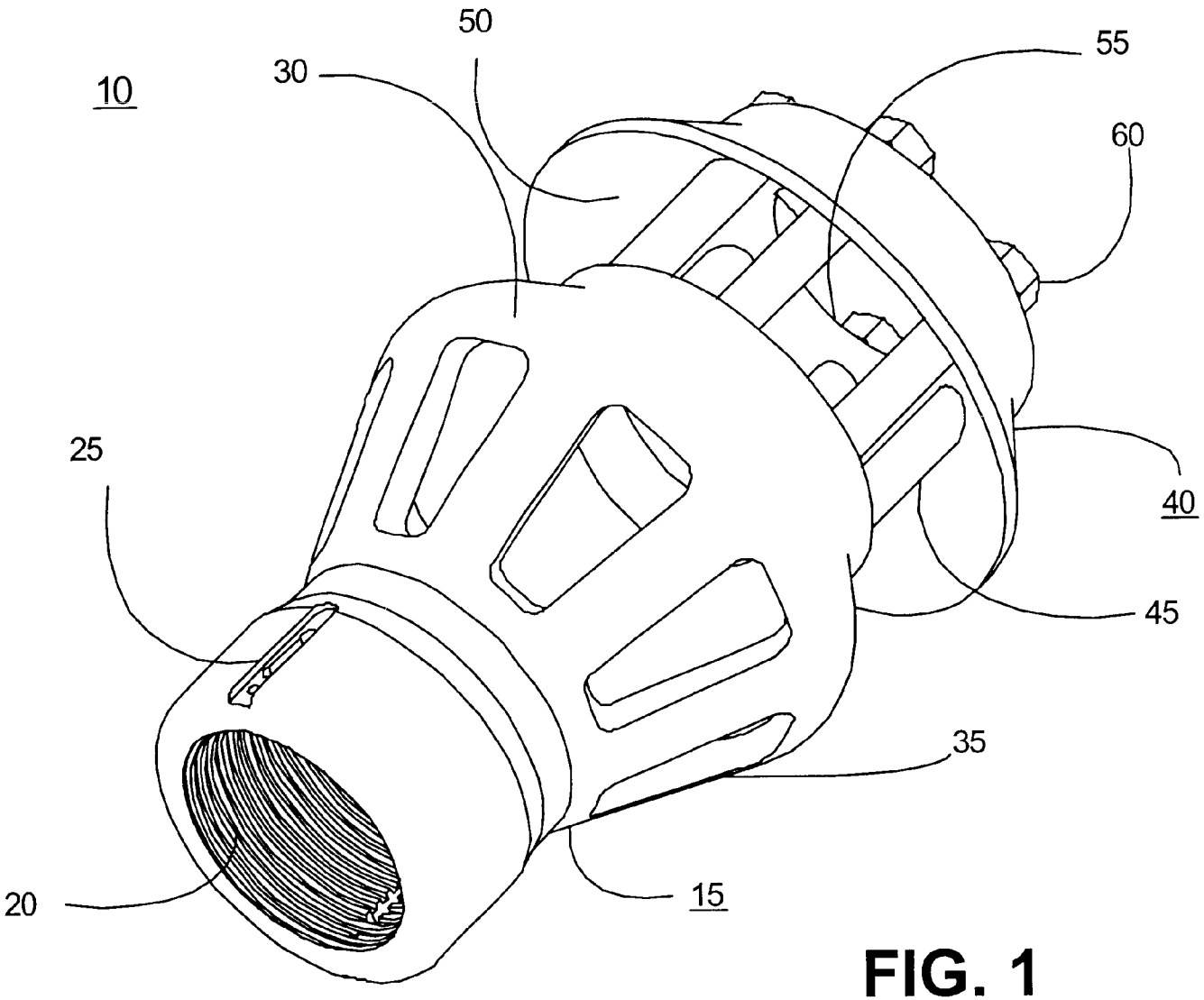
FIG. 1 is an isometric view of the muzzle brake of the current invention.

FIG. 1 provides an isometric depiction of a radially-venting baffled muzzle brake 10 of the current invention. In a preferred embodiment, the radially-venting muzzle brake 10 comprises a main body 15 and a second stage baffle 40. The main body 15 displays a number of important features including internal threads 20 for mounting the main body directly to the muzzle end of a cannon or other large caliber gun. A pair of slots 25, located 180 degrees apart, are used as part of a secondary locking mechanism.

The primary deflection baffle 30 deflects and redirects a major fraction of the expanding, high velocity propellant gases such that their velocity vector contains both components that are radially outward and axially directed back toward the breech of the gun. The resulting change in the velocity vector of the gas and accompanying impulse leads to the desired reduction in recoil force. The deflected gases are ejected into the ambient atmosphere through a plurality of gas exhaust ports 35, located symmetrically around the circumference of the main body 15. Gas dynamic efficiency may be increased or decreased by altering physical characteristics of the baffle, including its size, gas deflection angle, corner radii, and gas exit area.

In the preferred embodiment, the main body is augmented by a second stage baffle 40 that is attached to the main body by multiple standoffs 45. A secondary deflection baffle 50 is secured between the standoffs 45 and nuts 60. A fraction of the exhaust gases not deflected by the primary deflection baffle 30 is intercepted and redirected by the secondary deflection baffle 50. Propellant gases are vented to the atmosphere via the secondary gas exhaust ports 55. This redirection and venting of the propellant gases produces a second impulse that counters the recoil force of the gun.

The efficiency of the second stage baffle 40 can be "tuned" by adjusting the length and number of standoffs 45 as well as by changing the design of the secondary deflection baffle 50. The addition of the second stage baffle 40 can raise the gas dynamic efficiency of the radially-venting baffled muzzle brake of the current invention to a value exceeding 1.2, substantially exceeding that of the "German baffle" and doubling that of the integrated, perforated tube brake.

In some cases, it may be advantageous to include additional baffles, thus raising the gas dynamic efficiency, $\beta$, to a value that further exceeds 1.2. Tertiary and subsequent baffles may be observed to mimic the axisymmetric design and implementation of the second stage baffle 40.

Figure 2:
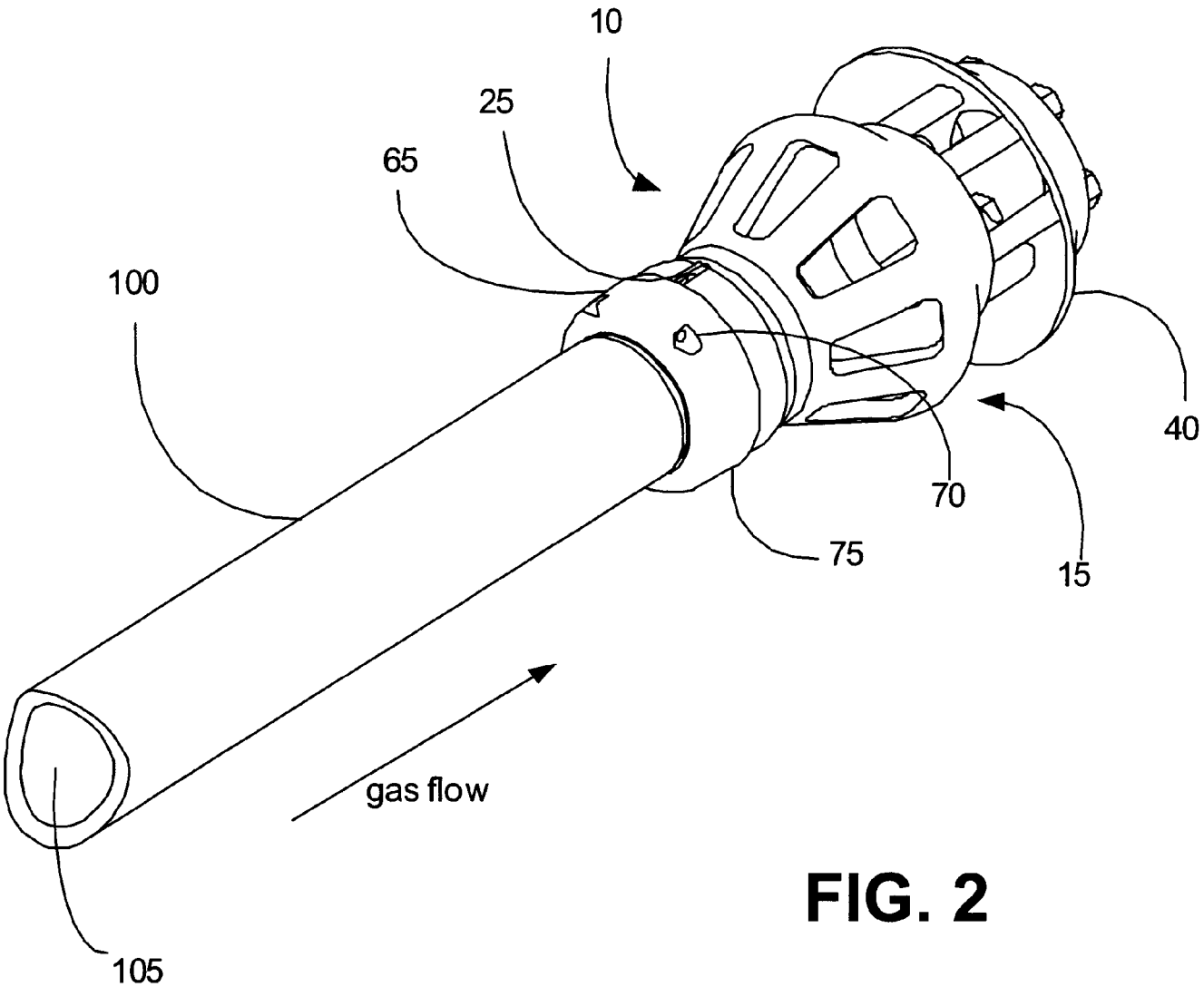
FIG. 2 is an isometric view of the muzzle brake of FIG. 1 as installed on a large bore cannon, showing the relative size and installed location of the brake.

FIG. 2 illustrates the primary use and deployment of the invention of FIG. 1. The radial-venting baffled muzzle brake is installed on the threaded muzzle end of a large caliber gun. In particular, the threaded main body 15 is secured to the muzzle end of the barrel 100. To prevent the brake 10 from loosening under repeated firing, the main body is further secured to the muzzle of the gun by means of a key system 75. A collet 65, slid over the muzzle before the brake 10 is installed, is tightened on the outer diameter of the barrel by means of locking screws 70. This provides an interference fit between the collet and the main body and a mating function with the slot 25, thus impeding rotation and preventing loosening of the muzzle brake during repeated firing. in a specific embodiment, a key fits into slot 25, and also into a slot in the cannon. The collet 65 houses a pair of setscrews, which secure the key and thus prevents the relative rotation between the key, the collet, the cannon, and the muzzle brake.

FIG. 2 further serves to illustrate the efficacy of the invention. Propellant gases traveling axially along bore of the barrel 105 reach the brake 10, are deflected, and then ejected in a direction that has both radial- and breech-directed components. The change in the momentum of the gases resulting from the redirection of their velocity vector produces an impulse that substantially reduces recoil force.

Figure 3:
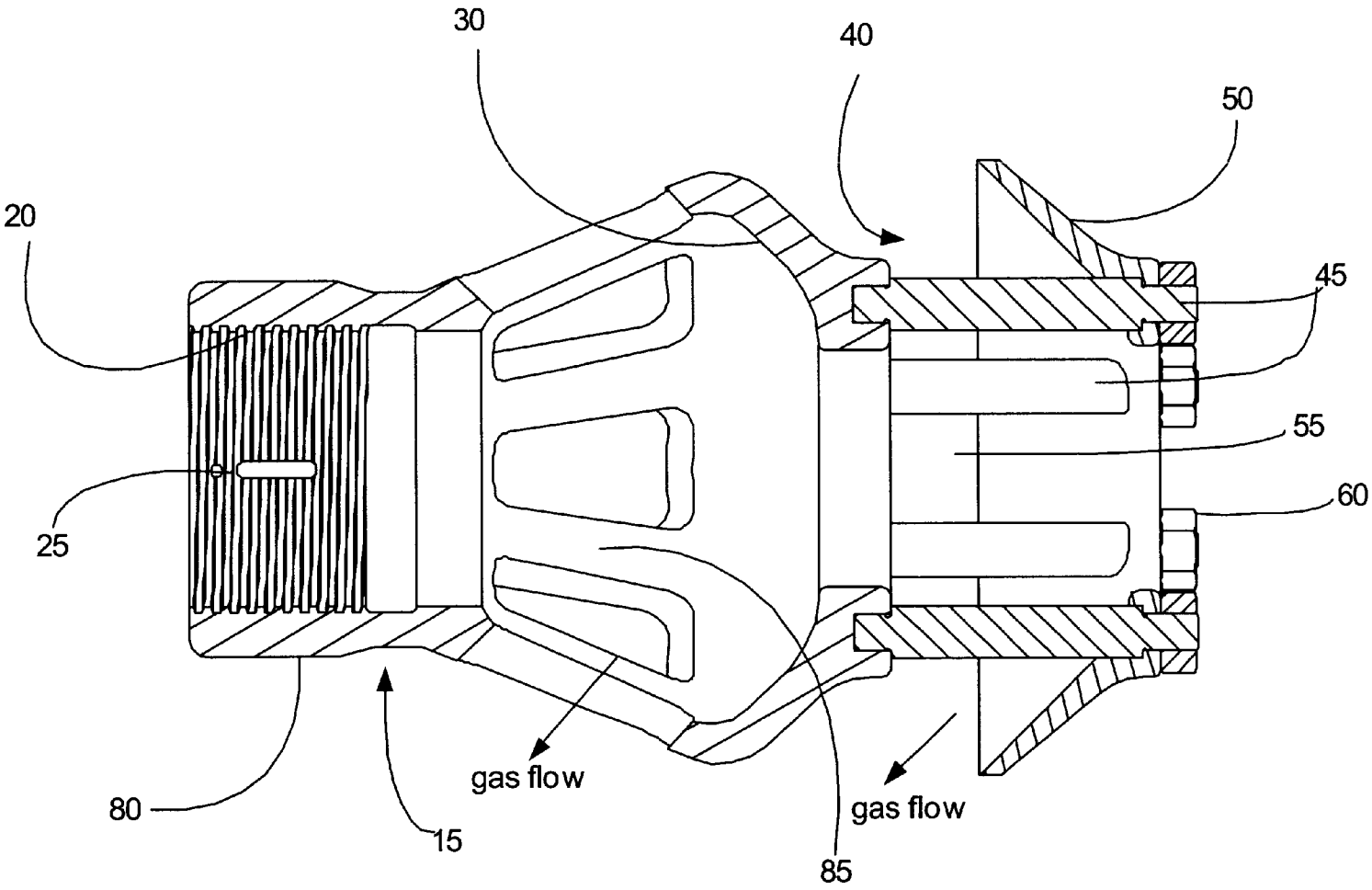
FIG. 3 is a cross sectional view of the muzzle brake of FIG. 1 displaying the important components comprising the current invention including the main body and the secondary baffle.

FIG. 3 provides a cross-sectional view of the invention of FIG. 1 and illustrates the major features of the invention. Within the main body 15, integral threads 20 cut into the cannon interface lug 80 provide the mating mechanism for mounting the muzzle brake to the muzzle of the gun barrel. Slot 25 is used to mate the body of the brake 10 to the cannon and the collet 65, shown previously in FIG. 2, which prevents loosening of the muzzle brake under repeated firing. The primary deflection baffle 30 efficiently redirects a large fraction of the expanding propellant gases emanating from the muzzle of the gun barrel. The gases are ejected uniformly around the periphery of the muzzle brake through the gas exhaust ports 35. The change in momentum associated with the redirection of the gases leads to the desired reduction in recoil force.

The primary baffle 30 is radially uniform and, further, is designed to produce smooth transition to the radial exit passages, thereby maximizing its efficiency. In addition, the radial venting baffled muzzle brake incorporates axisymmetric exhaust ports 35 separated by an equal number of gas exit area plates 85. The geometry of each of these features strongly contributes to muzzle brake efficiency. Furthermore, the fillet radii transition between the main body's primary baffle 30 and the exhaust ports 35 is carefully engineered to assure structural integrity while maximizing brake performance. Specifically, the design's uniformity of the structure enhances stress distribution from firing loads while maintaining high gas dynamic efficiency.

Propellant gases not redirected by the primary deflection baffle 30 and, thus, not expelled through the primary exhaust ports 35, continue to move axially through the structure of the brake 10 transitioning from the main body 15 into the area of the second stage baffle 40. As in the case of the integral first stage brake, the projectile impedes flow of gas in the axial direction. A significant fraction of the remaining gases interact with the secondary deflection baffle 50, passing between the standoffs 45 and through the secondary gas exhaust ports 55. The result is secondary impulse that serves to further counter the recoil of the gun. In particular, the desired momentum is generated by a gas velocity vector that contains both outward and rearward components.

The second stage baffle design allows for a smooth transition to the radial exit passages, thereby maximizing its efficiency. In comparison to a traditional "German baffle", the second stage baffle allows for a more radially uniform muzzle exit nozzle, which also strongly influences muzzle brake efficiency. Furthermore, the fillet radii transition between the baffle and the exit passage is designed to assure structural integrity while maximizing brake performance.

Standoff design is yet another important feature in the performance of the design of the second stage baffle 40. The standoffs thread directly into the front of the main body to position the second baffle at a predetermined distance away from the main body to maximize braking efficiency. The number of standoffs required are determined by the required structural integrity of the muzzle brake assembly. In general, the number and diameter of the standoffs is minimized to prevent exhaust gas restrictions. The standoffs arranged symmetrically to prevent any chance of asymmetric loading of the muzzle brake or the cannon. The six standoffs illustrated in FIG. 3 are typical of an efficacious design of a brake of the current invention. During assembly the secondary deflection baffle 50 is subsequently and readily secured to the standoffs 45 by nuts 60.

Figure 4A:
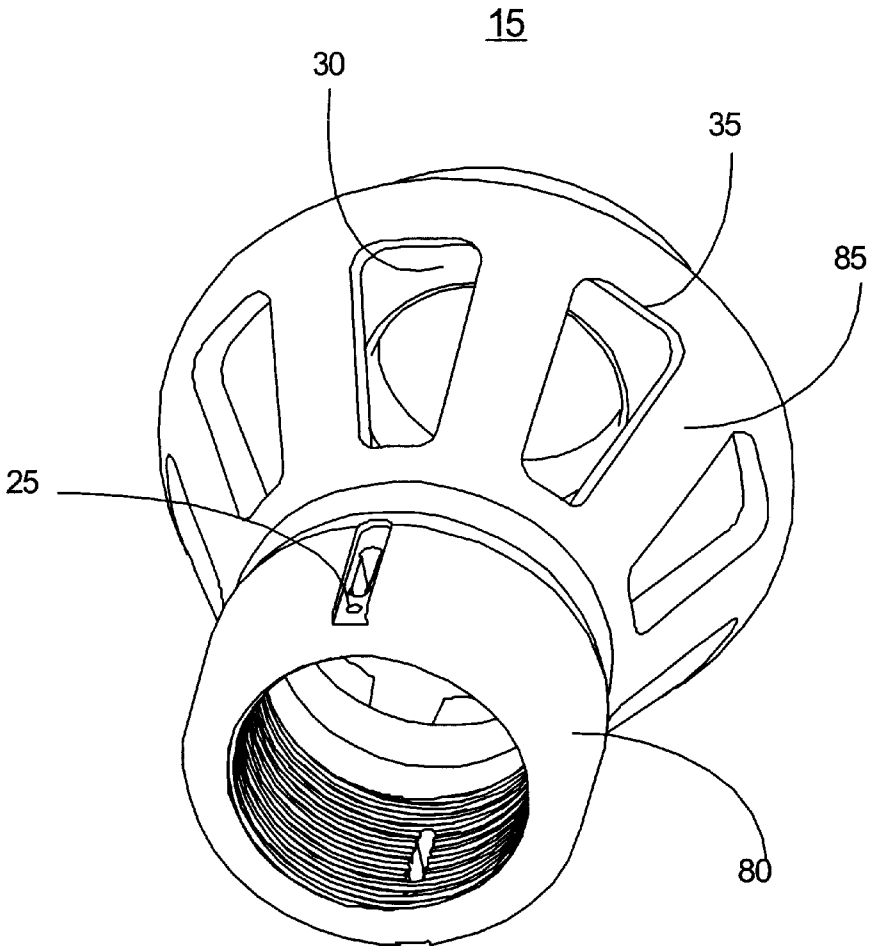
FIG. 4A is an isometric view of the details of the main body of the brake of FIG. 1 as viewed from the aft position, displaying the key construction and operational details of the invention.
Figure 4B:
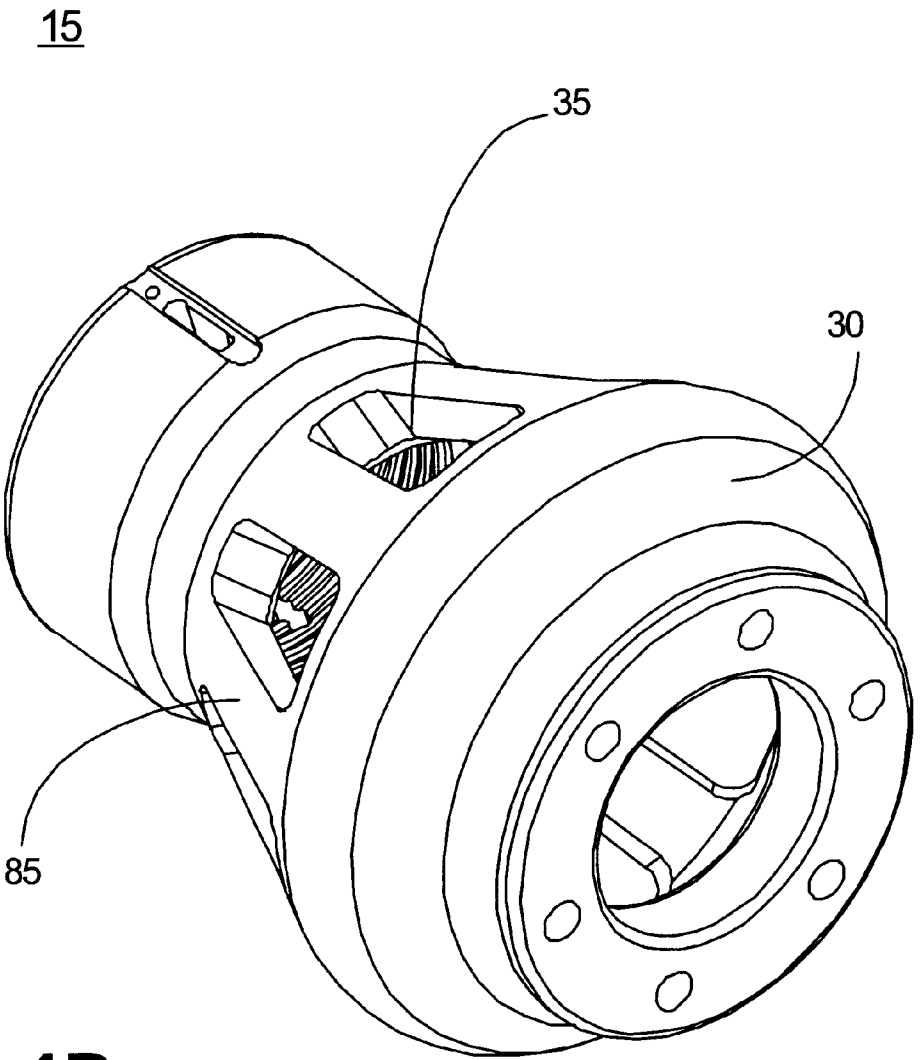
FIG. 4B is yet another isometric view of the main body of the brake of FIG. 1 as viewed from the muzzle end of the invention.

The symmetry and simplicity of the baffle design are important features leading to reductions in manufacturing costs and permitting standard manufacturing techniques to be employed. Simplicity and symmetry is further emphasized in the perspective views of the main body 15 as depicted in FIGS. 4A and 4B. In both FIGS. 4A and 4B, the cylindrical symmetry of the main body 15 may be observed to be broken only by the slots 25.

FIG. 4A emphasizes the construction of the cannon interface lug 80, which is equipped with internal threads 20 and slots 25 that facilitate the mating to the muzzle of the cannon barrel. A plurality of gas exit area plates 85 separate the individual primary gas exhaust ports 35. Gas is expelled into the atmosphere through the exhaust ports 35 after interacting with the integral gas deflection baffle 30.

FIG. 4B serves to further illustrate the high degree of symmetry of the main body 15 and the design of the exhaust ports and gas exit area plates that provide axisymmetric ejection of gas and uniform loading on the structure. Both features are important to high gas dynamic efficiency and a robust mechanical design.

It is envisioned that the main body and the baffle components will be fabricated from a lightweight, high-strength titanium alloy as opposed to traditional steel alloys. Previous efforts in fabricating such components from titanium have resulted in premature failure, due to erosion of the baffle surfaces by the high-temperature, high-speed propellant gases. Thus, the affected surfaces of the proposed design will be treated with a unique high velocity oxy-fuel (HVOF) coating, similar in type to those which are currently utilized on titanium alloy gas turbine blades, in order to prevent and/or delay the erosive effects. The utilization of the titanium alloy for the main structural components will result in a system weight comparable to that of the perforated muzzle brake designs that are currently employed on other artillery systems. If weight savings is not paramount, the main body can be constructed from steel, if desired.

Figure 5:
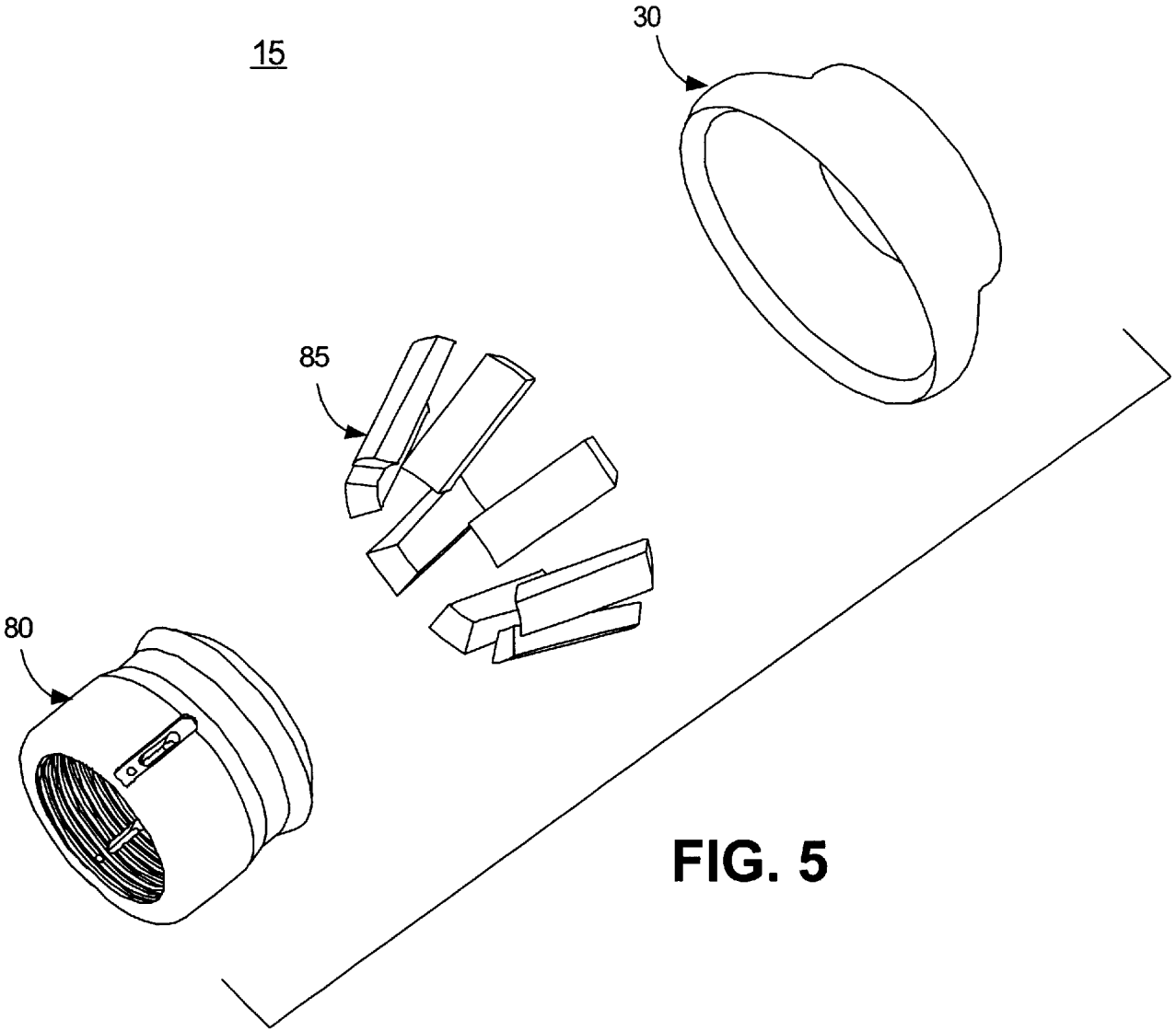
FIG. 5 is an exploded view of one method of fabrication of the main body of the brake of FIG. 1 with emphasis on the uniformity, simplicity and manufacturability of the invention.

FIG. 5 provides an exploded view of the component parts of the main body 15. As previously noted, an important feature of the current invention include relatively low production costs as afforded by conventional fabrication. In particular, the uniformity in design of the main body of the radial venting baffled muzzle brake enhances the producibilty of the item, thus reducing manufacturing costs. The threaded cannon interface lug 80 may be either forged or machined with conventional tooling (e.g., lathes and milling machines) from round bar stock. This manufacturing technique offers superior structural strength as compared to complex castings that are typically employed in certain baffles.

An exemplary number (eight) of radially-oriented gas exit area plates 85 are shown, but this quantity may vary based upon physical conditions and desired muzzle brake characteristic. It is envisioned that the exit are plates 85 will be machined from plate stock and welded to both the cannon interface lug 80 and the gas deflection baffle 30 to form the main body 15. These plates may be chamfered to modify the geometry of the gas exit nozzles, which will affect the gas dynamic efficiency of the muzzle brake. The gas deflection baffle 30 will be either forged or machined from plate stock. The fillet radii transition between the main body's primary baffle 30 and the exhaust ports 35 are engineered to assure structural integrity while maximizing brake performance.

Figure 6:
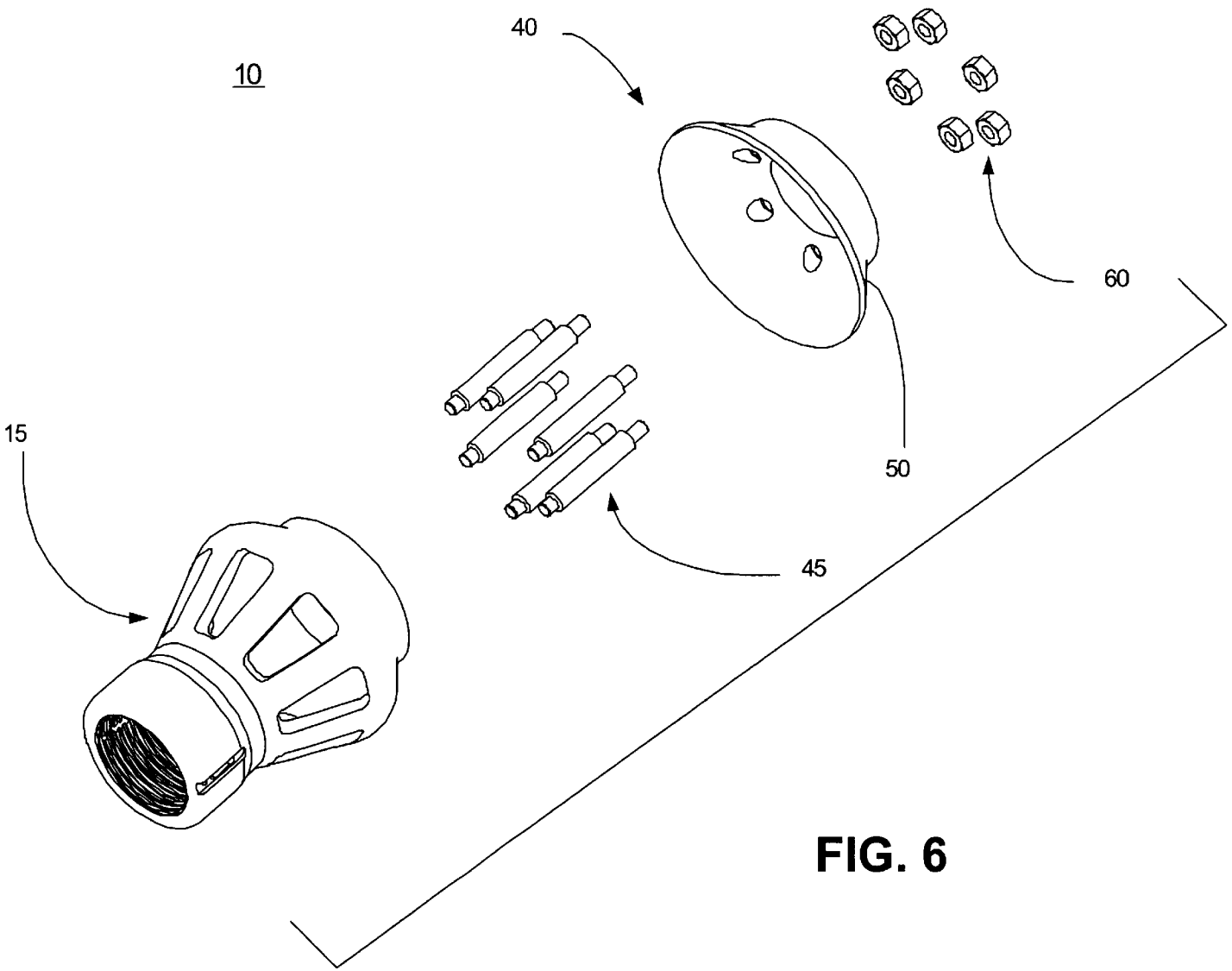
FIG. 6 is an exploded view of the muzzle brake of FIG. 1 emphasizing the components and assembly details of the second baffle onto the main body.

FIG. 6 offers an exploded view of the primary components of the second stage baffle 40 along with the assembled main body 15. In keeping with the general design constraints and guidelines, the standoffs 45 and secondary deflection baffle 50 display axial symmetry, thus permitting conventional production techniques to be employed. In the assembly of the unit the plurality of symmetrically located standoffs 45 are threaded into the main body 15. The secondary deflection baffle is fitted over the threaded ends of the standoffs 45 and held in place with nuts 60. These secondary baffles can be formed, forged or machined to provide more flexibility in manufacturing.

As noted, the design of the second stage baffle allows it and its contribution to recoil reduction to be readily changed. For instance, the diameter and length of the standoffs can be changed to effectively "tune" the efficiency of the second stage baffle. In particular, the standoff length and diameter determine the area, and thus the efficiency, of the exhaust gas exit passage for the second stage baffle. In addition, the secondary baffle may be easily removed when operational conditions warrant. Examples include stowage for enhancement vehicle transportability and operations where overall weapons length must be minimized.

It should be apparent that many modifications may be made to the invention without departing from the spirit and scope of the invention.

What is claimed is:

1. A radial venting baffled muzzle brake for reducing a momentum of a recoiling component of a gun, comprising:

a main body secured to a primary baffle for providing a first muzzle gas braking stage;

a plurality of attachment standoffs; and a secondary baffle integrally secured to the primary baffle by means of the attachment standoffs for providing a second muzzle gas braking stage;

wherein the primary baffle includes at least four axisymmetric gas exhaust ports that are generally uniformly and symmetrically formed and separated by an equal number of similarly shaped plates, to deflect and to permit exhaust gases to escape, at least in part, to ambient atmosphere in a generally uniform way, peripherally around the first muzzle gas braking stage; and wherein exhaust gases that do not escape through the first muzzle gas braking stage are redirected by the secondary baffle, to escape to the ambient atmosphere through the second muzzle gas braking stage, resulting in a reduced recoil force.

2. The muzzle brake of claim 1, wherein at least some of the attachment standoffs are generally cylindrically shaped.

3. The muzzle brake of claim 1, wherein the main body includes a gun attachment for attachment to a gun.

4. The muzzle brake of claim 3, wherein the gun attachment is threaded.

5. The muzzle brake of claim 3, wherein the main body further includes means for connection to the attachment standoffs.

6. The muzzle brake of claim 5, wherein the connection means is threaded.

7. The muzzle brake of claim 5, wherein the main body further includes a projectile exit port to provide minimal escape of high velocity muzzle gases.

8. The muzzle brake of claim 7, wherein the main body further includes a plurality of keyslots to provide a gun locking attachment.

9. The muzzle brake of claim 1, wherein the main body further includes a fillet radii transition between the primary baffle and the gas exhaust ports for the purpose of providing uniform structural integrity to the main body.

10. The muzzle brake of claim 1, wherein the main body further includes a fillet radii transition between the primary baffle and the exhaust ports for diverting the exhaust gases with minimum turbulence.

11. The muzzle brake of claim 9, wherein the primary baffle is generally conically shaped for diverting the exhaust gases.

12. The muzzle brake of claim 1, wherein the attachment standoffs include means for attachment to the main body; and means for attachment means to the secondary baffle.

13. The muzzle brake of claim 12, wherein the attachment standoffs further include a cylindrical standoff region.

14. The muzzle brake of claim 1, wherein the secondary baffle includes means for attachment to the attachment standoffs.

15. The muzzle brake of claim 14, wherein the secondary baffle further includes a projectile exit port to provide minimal escape of the exhaust gases.

16. The muzzle brake of claim 15, wherein the secondary baffle further includes a fillet radii transition between a projectile exit port and a deflected gas exhaust area for diverting the exhaust gases with minimum turbulence.

17. The muzzle brake of claim 16, wherein the secondary baffle further includes a fillet radii transition between the projectile exit port and the deflected gas exhaust area for providing uniform structural integrity to the muzzle brake.

18. The muzzle brake of claim 1, wherein the primary baffle and the secondary baffle force the exhaust gases to be ejected in a direction that has a radial-directed component and a breech-directed component.

19. The muzzle brake of claim 1, wherein the plates are uniformly shaped.

20. The muzzle brake of claim 19, wherein the plates have a uniform length.

21. The muzzle brake of claim 19, wherein the plates have a uniform width.

22. The muzzle brake of claim 19, wherein the plates have a uniform thickness.

* * * * *